US008944137B2

(12) United States Patent
Miller

(10) Patent No.: US 8,944,137 B2
(45) Date of Patent: Feb. 3, 2015

(54) SHUTTER SLAT

(71) Applicant: James V. Miller, Glen Ellyn, IL (US)

(72) Inventor: James V. Miller, Glen Ellyn, IL (US)

( * ) Notice: Subject to any disclaimer, the term of this patent is extended or adjusted under 35 U.S.C. 154(b) by 0 days.

(21) Appl. No.: 13/772,154

(22) Filed: Feb. 20, 2013

(65) Prior Publication Data

US 2014/0053990 A1 Feb. 27, 2014

Related U.S. Application Data

(60) Provisional application No. 61/600,909, filed on Feb. 20, 2012.

(51) Int. Cl.

| | |
|---|---|
| ***E06B 9/15*** | (2006.01) |
| ***E06B 9/34*** | (2006.01) |
| ***E06B 9/58*** | (2006.01) |
| *E06B 9/00* | (2006.01) |

(52) U.S. Cl.

CPC ... *E06B 9/34* (2013.01); *E06B 9/15* (2013.01); *E06B 9/581* (2013.01); *E06B 2009/005* (2013.01); *E06B 2009/1544* (2013.01)

USPC ..... 160/236; 160/235

(58) Field of Classification Search

USPC ..... 160/236, 235, 133; 49/92.1

IPC ..... E06B 9/15,2009/1516, 2009/1522, E06B 2009/1538

See application file for complete search history.

(56) References Cited

U.S. PATENT DOCUMENTS

| | | | | |
|---|---|---|---|---|
| 638,314 | A | | 12/1899 | Blades |
| 845,526 | A | | 2/1907 | Collins |
| 876,593 | A | | 1/1908 | Rush |
| 1,014,315 | A | | 1/1912 | McCloud |
| 1,352,656 | A | | 9/1920 | Cahill |
| 1,579,839 | A | | 4/1926 | Raper |
| 1,776,119 | A | | 9/1930 | Johnson |
| 1,892,570 | A | | 12/1932 | Ginder |
| 1,918,415 | A | | 7/1933 | Miller |
| 2,350,287 | A | | 5/1944 | Michelman |
| 2,495,963 | A | * | 1/1950 | Greegor ..... 160/235 |
| 2,545,400 | A | * | 3/1951 | White ..... 160/133 |
| 2,812,813 | A | | 11/1957 | Zarnowski |
| 2,858,883 | A | | 11/1958 | Rapin |
| 3,292,685 | A | | 12/1966 | Clark |
| 3,431,964 | A | | 3/1969 | Rogers |
| 3,489,200 | A | | 1/1970 | Recchione |
| 3,670,797 | A | | 6/1972 | Sassano |
| 4,037,639 | A | | 7/1977 | Jones |
| 4,294,302 | A | | 10/1981 | Ricke, Sr. |
| 4,332,287 | A | | 6/1982 | Stolpe |
| 4,343,340 | A | * | 8/1982 | Paule ..... 160/232 |
| 4,345,635 | A | | 8/1982 | Solomon |
| 4,379,479 | A | | 4/1983 | Whiting |
| 4,386,645 | A | | 6/1983 | Dever et al. |
| 4,519,434 | A | | 5/1985 | Forquer |
| 4,611,848 | A | | 9/1986 | Romano |
| 4,628,982 | A | | 12/1986 | Labelle |
| 4,690,193 | A | | 9/1987 | Morrison et al. |

(Continued)

*Primary Examiner* — David Purol

(74) *Attorney, Agent, or Firm* — Ice Miller LLP

(57) ABSTRACT

A slat for use in a rolling shutter is provided. The slat comprises a hooking track located at a first edge of a body and a receiving track located at a second edge of the body. Illustratively, the hooking track has a hook-shaped profile, and the receiving track comprises a lip member and a guard member defining a space adapted to receive therein an engaging track of an adjacent slat. The hooking track and the receiving track are designed to minimize the space required for the rolling shutter to be retracted around a spindle.

4 Claims, 3 Drawing Sheets

(56) References Cited

U.S. PATENT DOCUMENTS

| | | | | | |
|---|---|---|---|---|---|
| 4,718,472 | A | | 1/1988 | Hormann | |
| 4,723,588 | A | | 2/1988 | Ruppel | |
| 4,738,296 | A | | 4/1988 | Hatch | |
| 4,795,206 | A | | 1/1989 | Adams | |
| 4,807,687 | A | | 2/1989 | Finch et al. | |
| 4,929,862 | A | | 5/1990 | Hamilton et al. | |
| 4,930,563 | A | | 6/1990 | Finch et al. | |
| 5,070,925 | A | | 12/1991 | Paule | |
| 5,154,468 | A | | 10/1992 | Teigen et al. | |
| 5,165,746 | A | | 11/1992 | Teigen | |
| 5,204,147 | A | * | 4/1993 | Schneider | 428/35.8 |
| 5,209,281 | A | | 5/1993 | Kraeutler | |
| 5,253,694 | A | | 10/1993 | Bernardo | |
| 5,265,663 | A | | 11/1993 | Munekata et al. | |
| 5,343,924 | A | | 9/1994 | Hoffman | |
| 5,365,990 | A | | 11/1994 | Ueda | |
| 5,372,175 | A | | 12/1994 | Calhoun et al. | |
| 5,377,738 | A | | 1/1995 | Cooper | |
| 5,426,893 | A | | 6/1995 | Hoffman | |
| 5,469,905 | A | | 11/1995 | McKinney et al. | |
| 5,482,104 | A | | 1/1996 | Lichy | |
| 5,575,322 | A | | 11/1996 | Miller | |
| 5,586,592 | A | | 12/1996 | McGregor | |
| 5,601,130 | A | | 2/1997 | Werner et al. | |
| 5,611,383 | A | | 3/1997 | Hoffman | |
| 5,613,539 | A | | 3/1997 | Kraler | |
| 5,657,805 | A | | 8/1997 | Magro | |
| 5,682,937 | A | | 11/1997 | Decrane et al. | |
| 5,839,493 | A | | 11/1998 | Quasius | |
| 5,850,862 | A | | 12/1998 | Miller | |
| 5,996,669 | A | | 12/1999 | Miller | |
| 6,085,822 | A | | 7/2000 | Miller | |
| 6,095,225 | A | | 8/2000 | Miller | |
| 6,422,289 | B1 | | 7/2002 | Miller | |
| 6,631,749 | B1 | * | 10/2003 | Zabala | 160/133 |
| 7,357,171 | B2 | * | 4/2008 | Miller | 160/235 |
| 7,784,522 | B2 | * | 8/2010 | Miller | 160/235 |
| 2007/0006980 | A1 | * | 1/2007 | Zabala et al. | 160/133 |
| 2007/0137802 | A1 | * | 6/2007 | Lukasik et al. | 160/235 |
| 2008/0202700 | A1 | | 8/2008 | Miller | |
| 2011/0162807 | A1 | | 7/2011 | Miller | |

* cited by examiner

SHUTTER SLAT

BACKGROUND OF THE INVENTION

The present invention relates to shutter slats and in particular to shutter slats of the roller type having improved resistance to storms and break-ins. It furthermore relates to shutter slats having compact retraction capability.

DESCRIPTION OF THE RELATED ART

Conventional roller shutters are designed to provide security from break-ins or protection from storms. Because such protection and security may not always be necessary or desired, such as during the day when a retail store is open for business or during fine weather when a homeowner wishes to open windows or enjoy an ocean view, roller shutters are designed to be retractable into a casing in which they are stored. In some examples, to facilitate compact storage, the rigid shutter slats that are designed to resist hurricane winds and burglars also must be capable of conforming to a roll.

One conventional shutter slat is made to conform to a roll by providing a loose articulation between slats. Slats are slidably engaged at the upper edge of one slat and the lower edge of another slat. The upper edge comprises a vertical projection terminating in a hook-shaped profile. The lower edge comprises a first portion and a second portion that cooperate to define a vertical pocket. The hook-shaped profile of the upper edge allows the upper edge to engage the first portion of the lower edge, also having a hook-shaped profile. The upper edge is prevented from undesirably disengaging the lower edge by the second portion of the lower edge, which comprises a guard extending downward to slightly below the hook-shaped profile of the lower edge, defining a horizontal aperture between the first and second portions of the lower edge. The vertical pocket defined by the first and second portions of the lower edge is similar in depth to the height of the vertical projection of the upper edge. This shutter configuration's flexibility arises from the pivoting of the vertical portion of the upper edge within the horizontal aperture.

One result of this configuration is that the upper edge has significant vertical clearance within the vertical pocket. Shutters according to this configuration are known to have a clearance up to one-quarter inch per slat, or even more. A shutter having 48 slats and one-quarter inch clearance per slat would then have a total clearance of twelve inches between the fully open and fully closed positions. To raise such a shutter having a torsion spring as a counterbalance, a user must lift the bottom slat either by hand or mechanically to correct for the full amount of clearance before the shutter will begin to retract. In such a shutter, a user would have to lift approximately 150 pounds by twelve inches in order to engage the shutter's retraction mechanism. Shutters of this configuration do not obtain full benefit of the counterbalance, as provided by the torsion spring or by other means.

A further result of this configuration is that the loosely articulated slats are known to be noisy. The slats rattle against each other during extension and retraction. In addition, when the roller shutter is deployed, the normal forces of the wind are sufficient to cause the slats to rattle audibly.

One solution to the problem of compact storage includes integration of a boss concentric with the articulation between adjoining slats, as described in U.S. Pat. No. 6,095,225 to Miller, titled "Shutter Slat with Integrated Boss." The slats in this configuration are also slidably engaged at the upper edge of one slat and the lower edge of another slat. The upper edge comprises a short vertical projection terminating in a c-shaped screw boss, and the lower edge comprises a c-shaped channel having a diameter sufficient to accommodate the upper edge. The flexibility of this shutter configuration arises from the cooperation of the rounded internal surface of the c-shaped channel and the rounded external surface of the c-shaped screw boss. The diameter of the upper edge is smaller than the diameter of the c-shaped channel, but greater than the width of the aperture defined by the c-shaped channel, preventing the upper edge from simply falling out of the c-shaped channel provided by the lower edge.

One result of this configuration is that if the exposed portion of the c-shaped channel of the lower edge gives way upon exertion of pressure on the articulation, the slats may separate undesirably. Because the retention of the upper edge by the c-shaped channel is based on a relatively small difference in size, damage to either edge may result in a breach of the rolling shutter. For example, if a putative intruder hits the shutter, the c-shaped channel may be forced open. Even if the channel is bent only slightly, once a gap is formed between an upper edge and a lower edge, the two slats may be pried apart with undesirably slight effort.

There is a need for shutter slats that completely minimize the space required for a rolling shutter made up of the slats to be wound up in a fully closed configuration. There is also a need for shutter slats that do not retain water, which can freeze and damage the slats.

SUMMARY OF THE INVENTION

The invention is a rolling shutter slat for use in a rolling shutter, said slat having a first end, a second end and a profile comprising a body having an upper edge and a lower edge, an outward facing side extending between the upper edge and the lower edge, and an inward facing side extending between the upper edge and the lower edge. The slat has engaging track connected to the body at the upper edge, the engaging track having a hook that extends upward from the upper edge at a smoothly curved transition between the engaging track and the upper edge. The slat further comprises a receiving track connected to the body at the lower edge, comprising a lip member having an outer lip surface and an articulating lip surface, the outer lip surface being contiguous with the inward facing side of the body and extending downward along the same curve as the inward facing side of the body to a curl, the curl extending upward to a tip. The receiving track further comprises a guard member spaced apart from the lip member, an articulation space wherein a second engaging track of a second identical slat may hook the lip member through an aperture between the lip member and the guard member to form a hinge, and a receptacle located between the lip member and the guard member that is separated from the articulation space by a first shoulder on the articulating lip surface and a second shoulder on the articulating guard surface, wherein the lowest point of the curl is horizontally displaced from the intersection of the second engaging track and a body of the second identical slat.

BRIEF DESCRIPTION OF THE FIGURES

Embodiments of the invention will now be explained in further detail by way of example only with reference to the accompanying figures, in which.

DETAILED DESCRIPTION OF THE INVENTION

Figure 1:
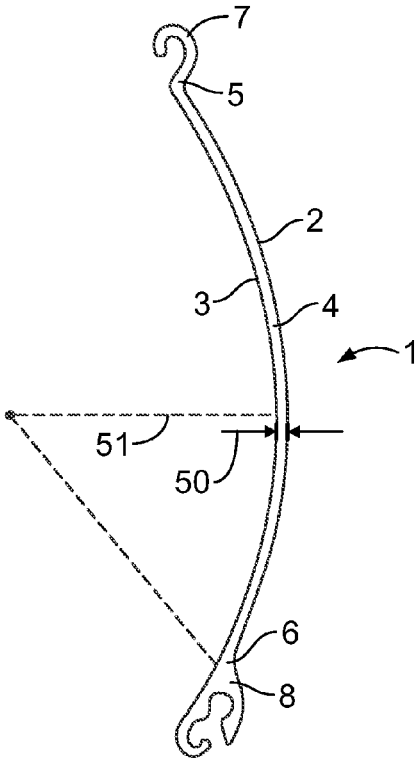
FIG. 1 is a side view of a shutter slat according to the present invention.
Figure 2:
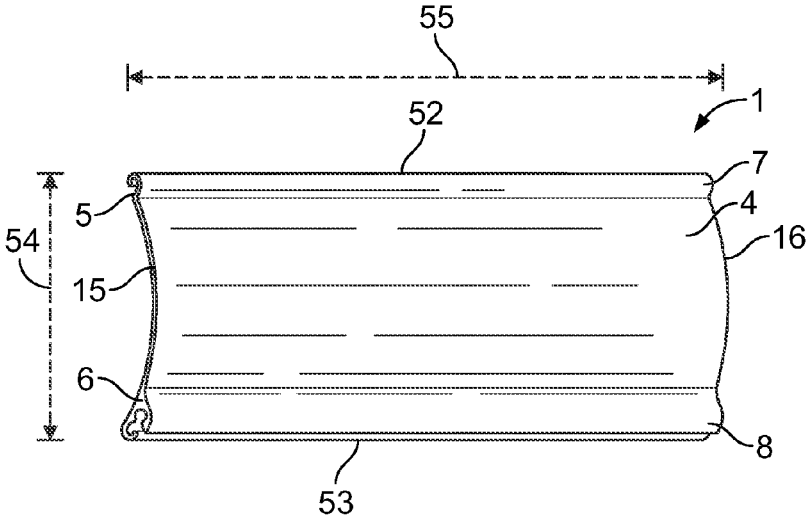
FIG. 2 is an elevation of a shutter slat according to the present invention.

FIGS. 1 and 2 show a shutter slat 1 according to the present invention. Illustratively, shutter slat 1 is an elongated body of extruded aluminum having a body portion 4, a hooking track 7, and a receiving track 8. The body portion 4 is bound by an outward facing side 2, an inward facing side 3, a first edge 5, a second edge 6, a first end 15 and a second end 16. In this embodiment, the slat is formed of a single ply of extruded aluminum; however, double-ply aluminum, as well as other metal or plastic materials is also contemplated.

FIG. 1 is a side view of a shutter slat 1 according to the present invention. The body portion 4 is a curved single-wall having an outward facing side 2, an inward facing side 3, a first edge 5, and a second edge 6. The outward facing side 2 of body portion 4 has a convex cross-section and the inward facing side 3 has a concave cross-section when sectioned vertically at any location along the length of slat 1. The distance between outward facing side 2 and inward facing side 3 defines the thickness 50 of body portion 4.

Figure 5:
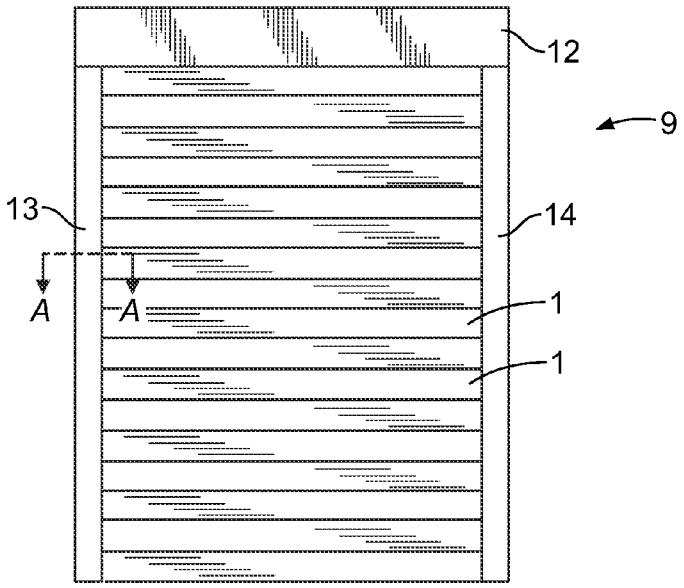
FIG. 5 is an elevation of a window aperture including a rolling shutter according to the present invention.

FIG. 2 is an elevation of a low-clearance shutter slat 1 according to the present invention. The distance between the upper end 52 of hooking track 7 and the lower end 53 of receiving track 8 defines the vertical height 54 of slat 1. However, each slat 1 in a rolling shutter 9 may not have the same vertical height 54. Those skilled in the art will recognize that the vertical height 54 of slat 1 is not critical so long as the slat 1 is conformed to roll into a shutter casing 12 (FIG. 5). It may be advantageous to vary the vertical heights 54 of slats 1 in a rolling shutter 9 to minimize the space required to retract the rolling shutter 9 into a fully closed position.

The distance between first end 15 and second end 16 of body portion 4 defines the overall horizontal width 55 of slat 1. The overall horizontal width 55 must be wide enough to cover a building aperture or other opening in which a rolling shutter 9 made with slats 1 is designed to protect.

Figure 9:
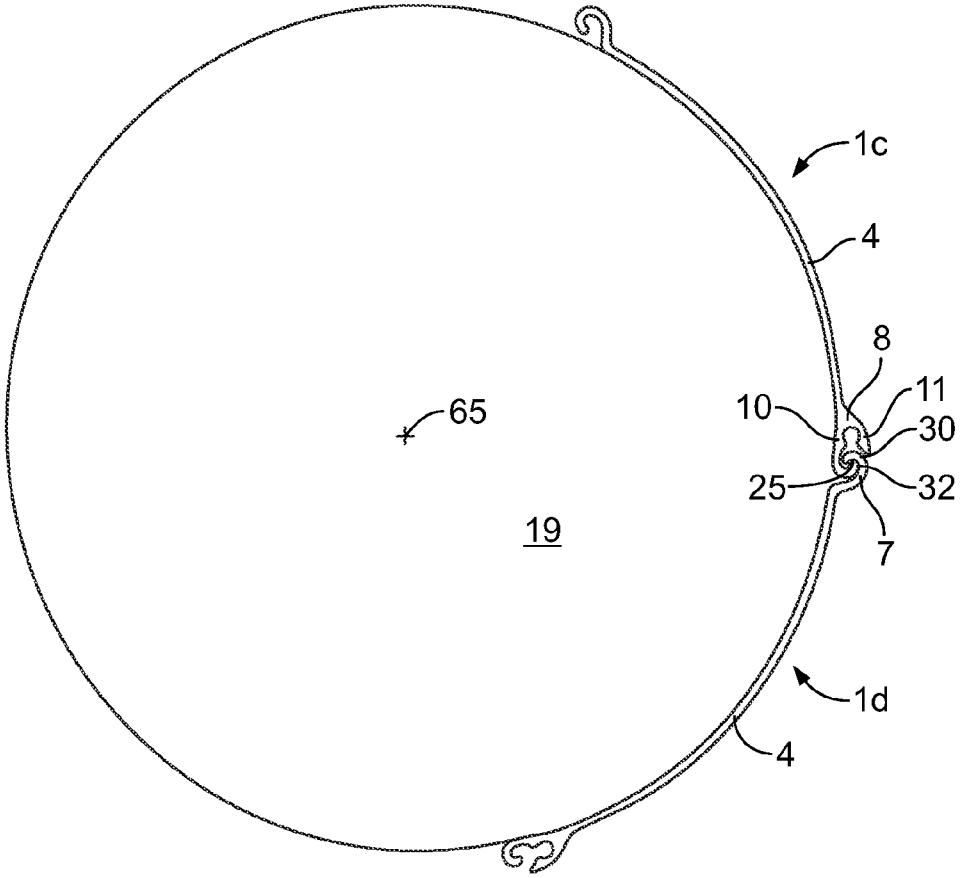
FIG. 9 is a side view of the cooperation of two shutter slats according to the present invention when the shutter slats are in a closed position.

Outward facing side 2 and inward facing side 3 are both formed with a radius of curvature 51. However, those skilled in the art will recognize that radius of curvature 51 is not critical so long as slat 1 is conformed to wrap around a spindle 19 (FIG. 9). The overall vertical height 54 and the radius of curvature 51 of body portion 4 cooperate to allow a rolling shutter 9 formed by slats 1 to roll when retracted around a spindle 19. The radius of curvature 51 of body portion 4, the overall vertical height 54, and the thickness 50 are selected to facilitate retraction and winding of a rolling shutter 9 formed from slats 1 around the spindle 19 and to provide strength to the rolling shutter 9.

Figure 3:
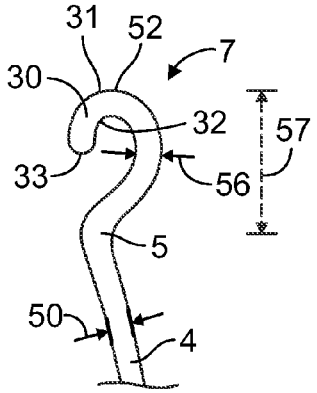
FIG. 3 is a detailed view of a hooking track according to the present invention.

FIG. 3 is a detailed view of hooking track 7, which is connected to body portion 4 at first edge 5, which is a smooth concave transition. Hooking track 7 includes a hook 30 with an outer surface 31, an inner surface 32, and a tip 33. Hooking track 7 is formed integrally with body portion 4. However, it is understood that hooking track 7 could be formed separately and fixed to body portion 4. It is also understood that hooking track 7 could, in the alternative, be located at second edge 6.

Hook 30 of hooking track 7 has a profile that is dimensioned to be substantially similar to the profile of articulation space 20 of receiving track 8. Hook 30 may have a single radius, or the radius may change along the profile of hook 30. In the embodiment shown, the radius of hook 30 decreases closer to tip 33.

Outer surface 31 has a radius of curvature that in conjunction with the radius of curvature of inner surface 32 causes hooking track 7 to have a substantially uniform thickness 56 from tip 33 to first end 5 of body portion 4. The thickness 56 of hooking track 7 in this embodiment is substantially similar to the thickness 50 of body portion 4. Hooking track 7 also has a vertical height 57 that extends from first edge 5 to upper end 52.

Figure 4:
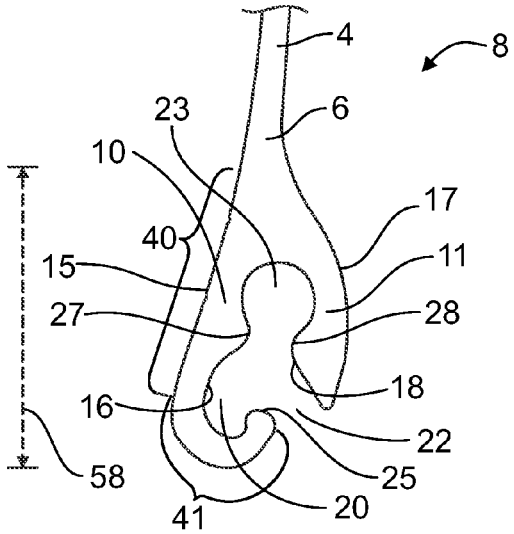
FIG. 4 is a detailed view of a receiving track according to the present invention.

FIG. 4 is a detailed view of receiving track 8, which is connected to body portion 4 at second edge 6. Receiving track 8 includes a lip member 10, a guard member 11, and an articulation space 20. Receiving track 8 may also include a receptacle 23. Receiving track 8 is formed integrally with body portion 4. However, it is understood that receiving track 8 could be formed separately and fixed to body portion 4.

Receiving track 8 has a vertical height 58 that extends from second edge 6 to lower end 53. However, those skilled in the art will recognize that the vertical height 58 of receiving track 8 is not critical so long as receiving track 8 is dimensioned to engage hooking track 7.

Lip member 10 has an outer lip surface 15, an articulating lip surface 16, and a tip 25. Outer lip surface 15 further includes an outer lip wall 40 and an outer lip curl 41. Outer lip wall 40 of outer lip surface 15 is contiguous with the inward facing side 3 of body portion 4 such that the curvatures 51 of inward facing side 3 and outer lip wall 40 are the same, and there is no break between inward facing side 3 and outer lip wall 40. This common curvature 51 minimizes the space taken up by slat 1 when a rolling shutter 9 made of slats 1 is retracted into a fully closed position.

Guard member 11 has an outer guard surface 17 and an articulating guard surface 18. As shown, articulating surfaces 16 and 18 may be wholly or partially concave. Such concave articulating surfaces allow for improved articulation between adjacent slats without the need to provide additional vertical clearance.

Articulation space 20 is the space within which a hooking track 7 of an adjacent slat 1 is received in receiving track 8 to form a rolling shutter 9. The tip 25 of lip member 10 and the articulating guard surface 18 of guard member 11 define an aperture 22 communicating with articulation space 20. Hook 30 of hooking track 7 of the adjacent slat 1 is dimensioned to enter articulation space 20 through aperture 22. The profile of articulation space 20 is dimensioned to substantially match the profile of hook 30 of hooking track 7. Tip 33 of hook 30 of the adjacent slat 1 seats against articulating lip surface 16 of lip member 10, thereby forming a hinge between hooking member 7 of the adjacent slat 1 and receptacle member 8. Outer surface 31 of hook 30 of the adjacent slat 1 contacts articulating guard surface 18 of guard member 11, thereby preventing hooking member 7 of the adjacent slat 1 from disengaging with receptacle member 8.

In prior art designs, receiving tracks have thin guard members that are substantially vertical when the slat is in a vertical position. The lowest point of such a prior art guard member extends below the lowest point of the communicating lip member. Guard member 11 is considerably shorter than the guard members of prior art slats, and the lowest point of guard member 11 terminates above the lowest point of lip member 10 when slat 1 is in a vertical position. Because guard member 11 is shorter in relation to the lip member, it is thickened and reinforced at the point where it engages the hooking track 7 of the adjacent slat 1 without appreciably increasing the amount of extruded aluminum required to form receiving track 8, further increasing the security of the hinge formed by two slats without requiring additional material expense. The increased thickness of guard member 11 also protects slat 1 from excessive articulation that may disengage the hinge formed with the hooking track of another slat 1.

Figure 6:
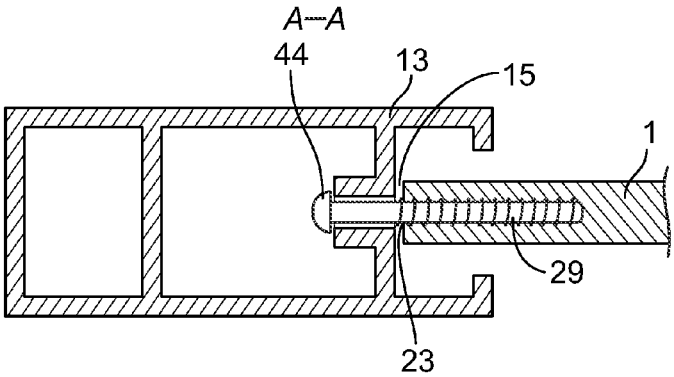
FIG. 6 is a partial horizontal sectional view of a shutter slat according to the present invention engaged in a track, taken along lines A-A.

Receptacle 23 is adapted to receive a retention or alignment device 29 (FIG. 6). This retention or alignment device may be a screw, bolt, or other device capable of being retained by the receptacle and capable of aligning slats with one another and/or retaining the slat to a guide. Articulating lip surface 16 has a shoulder 27 which separates articulation space 20 from receptacle 23, and articulating guard surface 18 has a shoulder 28 which separates articulation space 20 from receptacle 23. When slat 1 is in a vertical position, as shown in FIG. 1, receptacle 23 is located above shoulders 27 and 28. As shown in FIG. 4, it is advantageous to locate receptacle 23 between the body portion 4 and aperture 22. It is understood that if receiving track 8 were located at first edge 5 of slat 1, receptacle 23 still would be located between body portion 4 and aperture 22.

While receptacle 23 is a space distinct from articulation space 20 and separated by shoulders 27 and 28, as shown, receptacle 23 has a portion that is open to and in communication with articulation space 20. The hooking track 7 of an adjacent slat 1 cannot enter the gap between first shoulder 27 and second shoulder 28 and cannot be retained in receptacle 23. Although receptacle 23 is in open communication with articulation space 20, receptacle 23 is protected from the collection of dirt and grime by lip member 10 and guard member 11, and by the hooking track 7 of an adjacent slat 1. If desired, it is understood that receptacle 23 may be completely separated from articulation space 20. In such an embodiment, articulating surfaces 16 and 18 would be connected at shoulders 27 and 28 to provide a single, continuous articulating surface for the hooking track 7 of a second slat 1.

FIG. 5 shows an elevation of a plurality of shutter slats 1 according to the present invention, articulated into a rolling shutter 9 which may be installed on a building aperture such as a window or door. Details of the building aperture are not illustrated for the sake of clarity. The building aperture is further equipped with shutter casing 12 and a pair of guides 13 and 14, located on opposite lateral edges of the building aperture. Rolling shutter 9 may be rolled up for storage within shutter casing 12. The first and second ends 15 and 16 of slat 1, as shown in FIG. 2, are adjacent guides 13 and 14. Retention screw 29 provides for secure alignment of ends 15 and 16 with guides 13 and 14.

FIG. 6 is a partial sectional view taken along lines A-A of FIG. 5. A shutter slat 1 is shown in combination with a guide 13 and a retention screw 29. Retention screw 29 is preferably inserted in receptacle 23 of shutter slat 1 for use with guide 13. The head 44 of the retention screw 29 protrudes from receptacle 23 and slides within vertical guide 13 provided at the end of rolling shutter 9. In this illustrative embodiment, retention screw 29 does not restrict the rotation or pivoting of hooking track 7 within receiving track 8. As illustrated, for minimization of the rolling shutter, the diameter of the head 44 of retention screw 29 is not larger than the external profile of receiving track 8. Because of the space between head 44 of screw 29 and first end 15 of slat 1, the receiving track 8 of one slat 1 may slide horizontally with respect to the hooking track 7 of another slat 1. The amount of horizontal sliding may be limited in part by the space between head 44 of screw 29 and first end 15 of slat 1 or by the configuration of guides 13 and 14. An extended screw (not shown) with an extension member may be used in place of screw 29. The extension member of an extended screw is longer than head 44 of screw 29 and is better adapted to retain rolling shutter 9 within guides 13 and 14 during either an attempted break in or extreme wind conditions. An example of an extended screw is disclosed in U.S. Pat. No. 7,784,522.

Figure 7:
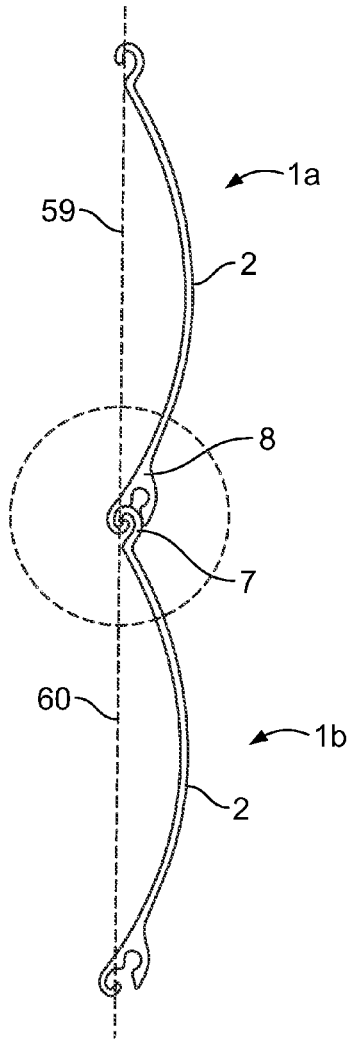
FIG. 7 is a side view of the cooperation of two shutter slats according to the present invention when the shutter slats are in an open position.
Figure 8:
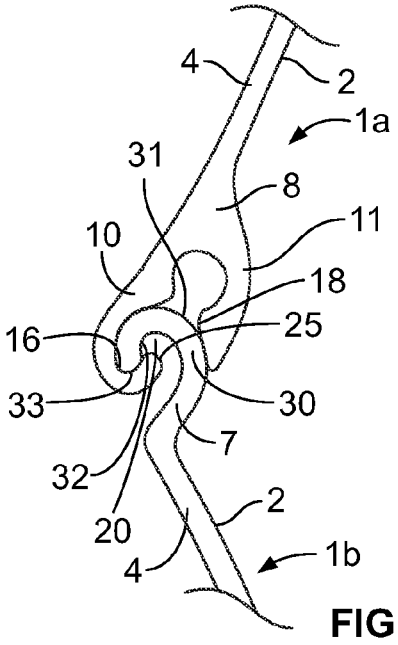
FIG. 8 is a detailed view of the cooperation between the hooking track and receiving track of the two shutter slats of FIG. 7.

FIG. 7 is a side view showing the cooperation of two slats 1*a* and 1*b* according to the present invention, and FIG. 8 is a detailed view of the cooperation of receiving track 8 of slat la and hooking track 7 of slat 1*b*. Both FIG. 7 and FIG. 8 show slats 1*a* and 1*b* engaging when the shutter slats are in an open position. As shown in FIG. 7, the bottom slat 1*b* is in a vertical position, i.e. the position as in an open shutter, with the vertical axis 59 of slat 1*a* substantially or completely in line with vertical axis 60 of slat 1*b*. There is very little clearance space provided between slats. Still, bottom slat 1*b* can articulate in a clockwise direction.

As shown in FIG. 8, hooking track 7 of slat 1*b* is slidably engaged with receiving track 8 of slat 1*a* to form a hinge between slats 1*a* and 1*b*. The outer surface 31 of hook 30 of slat 1*b* is convex and seats against the articulating lip surface 16 of lip member 10 and the articulating guard surface 18 of guard member 11 of slat 1*a*. Tip 33 of hook 30 of slat 1*b* also seats against articulating lip surface 16 of lip member 10 of slat 1*a*. Lip member 10 of slat 1*a* retains hook 30 of slat 1*b* in articulation space 20. Tip 25 of lip member 10 of slat 1*a* extends into a space defined by hook 30 of slat 1*b*. Tip 25 of lip member 10 of slat 1*a* also curls into articulation space 20, providing additional security to the hinge formed by hooking track 7 of slat 1*b* and receiving track 8 of slat 1*a*.

Guard member 11 shields the connection of hooking track 7 of slat 1*b* with lip member 10 of slat 1*a*, preventing hooking track 7 of slat 1*b* from disengaging from receiving track 8 of slat 1*a*. Guard member 11 also protects hooking track 7 of slat 1*b* and lip member 10 of slat 1*a* from exposure to forces applied to the outward facing sides 2 of slats 1*a* and *b*. In the open position, the weight bearing portion of receiving track 8 is lip member 10. Because hooking track 7 of slat 1*b* does not bear directly upon guard member 11 of slat 1*a*, damage to the outward facing side 2 of slat 1*a*, and to guard member 11 of slat 1*a*, is less likely to disengage the articulation between slats 1*a* and 2*b* than in prior art shutters in which an exposed portion of the lower track was weight bearing.

One advantage to the design of lip member 10 and guard member 11 is that slats 1*a* and 1*b* do not retain water in the hinge formed by hooking track 7 of slat 1*b* and receiving track 8 of slat 1*a*. Lip member 10 of slat 1*a*, at its lowest point, is horizontally displaced from the intersection of body portion 4 and hooking track 7 of slat 1*b*. The intersection of body portion 4 and hooking track 7 of slat 1*b* is a smooth transition. This design allows water to flow cleanly from lip member 10 of slat 1*a* without draining into the hinge formed by the intersection of slats 1*a* and 1*b*.

Slat 1 does not require a protrusion to prevent excessive articulation. With slat 1, guard member 11 is thickened in comparison to prior art slats. The thickness of guard member 11 and the shape of lip member 10 prevent slat 1 from excessive articulation, and there is no need for a protrusion on hooking member 7. Without a protrusion, there is no channel to retain water that drips off lip member 10. If water were to be retained, it could freeze and damage the hinge.

FIG. 9 is a side view showing the cooperation of two slats 1*c* and 1*d* engaging when the slats are in a closed position. As shown, tip 25 of lip member 10 of slat 1*c* lies flush against inner surface 32 of hook 30 of slat 1*d*, and body portions 4 of slats 1*c* and 1*d* form a substantially circular arc when the slats are in a fully closed position. This arc allows an initial subassembly of slats 1 of a rolling shutter 9 to lie substantially flush against spindle 19 when the slats are in a fully closed position, and allows subsequent subassemblies of slats 1 to form similar arcs around the initial subassembly and around other subassemblies. Those skilled in the art will understand that it may be advantageous to alter the arcs of the slats as the distance between the slats and the spindle increases to minimize the overall space needed for the rolling shutter 9 in its fully closed position.

The shape of guard member 11 further minimizes the overall radius of a rolling shutter 9 of slats 1 when the shutter is in a closed position. As set out above, guard member 11 is shorter and thicker than prior art slats, and the lowest point of guard member 11 is above the lowest point of lip member 10 when slat 1 is in a vertical position. As shown in FIG. 9, when slats 1*c* and 1*d* are in a closed position, guard member 11 of slat 1*c*, at its furthest point from the center 65 of spindle 19, is located approximately the same distance from the center 65 of spindle 19 as hooking track 7 of slat 1*d* at its furthest point from the center 65 of spindle 19. This configuration minimizes the overall radius of a rolling shutter 9 of slats 1 when the shutter is in a closed position by minimizing the overall radius taken up by each subassembly of slats circling spindle 19. The outer surface of guard 11, furthermore, is formed to be substantially parallel to the curvature of the body, thereby reducing the overall radius of the rolled up shutter slat.

Modifications in addition to those described above may be made to the structures and techniques described herein without departing from the spirit and scope of the invention. Accordingly, although specific embodiments have been described, these are examples only and are not limiting on the scope of the invention.

The invention claimed is:

1. A slat for use in a rolling shutter, comprising:

a body having an upper edge and a lower edge, an outward facing side extending between the upper edge and the lower edge, and an inward facing side with a concave curve extending between the upper edge and the lower edge;

an engaging track connected to the body at the upper edge, the engaging track comprising a hook that extends upward from the upper edge and the intersection between the engaging track and the body is a smoothly curved transition; and a receiving track connected to the body at the lower edge, the receiving track comprising a lip member having an outer lip surface and an articulating lip surface, the outer lip surface is contiguous with the inward facing side of the body and extending downward along the same curve as the inward facing side of the body to a curl, the curl extending upward to a tip;

the receiving track further comprising a guard member spaced apart from the lip member and having an articulating guard surface, an articulation space wherein a second engaging track of a second identical slat may hook the lip member through an aperture between the lip member and the guard member to form a hinge, and a receptacle located between the lip member and the guard member that is separated from the articulation space by a first shoulder on the articulating lip surface and a second shoulder on the articulating guard surface, wherein the lowest point of the curl is horizontally displaced from the intersection of the second engaging track and body of the second identical slat.

2. The slat of claim 1, wherein the tip of the curl is curved into the articulation space of the receiving track, such that the tip and guard member limit the articulation of the second engaging track.

3. The slat of claim 1, wherein the guard is thickened relative to the lip member, and extends to a point above the lowest point of the curl.

4. The slat of claim 1, wherein the guard member has a first outer surface and the hook has a second outer surface, the first and second outer surfaces forming a continuous curve wherein the second outer surface does not extend beyond a tangent to the first outer surface.

* * * * *